US009222653B2

(12) United States Patent
Holland et al.

(10) Patent No.: US 9,222,653 B2
(45) Date of Patent: Dec. 29, 2015

(54) CONCAVE LOW PROFILE LUMINAIRE WITH MAGNETIC LIGHTING DEVICES AND ASSOCIATED SYSTEMS AND METHODS

(71) Applicant: Lighting Science Group Corporation, Satellite Beach, FL (US)

(72) Inventors: Eric Holland, Indian Harbour Beach, FL (US); Mark Penley Boomgaarden, Satellite Beach, FL (US); Eric Thosteson, Satellite Beach, FL (US)

( * ) Notice: Subject to any disclaimer, the term of this patent is extended or adjusted under 35 U.S.C. 154(b) by 330 days.

(21) Appl. No.: 13/842,868

(22) Filed: Mar. 15, 2013

(65) Prior Publication Data

US 2014/0268733 A1 Sep. 18, 2014

Related U.S. Application Data

(63) Continuation-in-part of application No. 13/832,969, filed on Mar. 15, 2013.

(51) Int. Cl.
*F21V 1/00* (2006.01)
*F21S 4/00* (2006.01)
(Continued)

(52) U.S. Cl.
CPC ..... *F21V 21/096* (2013.01); *F21V 7/0008* (2013.01); *F21V 23/02* (2013.01); *H05B 33/0803* (2013.01); *F21V 29/773* (2015.01);
(Continued)

(58) Field of Classification Search
CPC ..... F21V 19/00; F21V 21/096; F21V 9/30
USPC ..... 362/249.11, 240, 239
See application file for complete search history.

(56) References Cited

U.S. PATENT DOCUMENTS 1,703,524 A 2/1929 Grandjean
3,706,882 A * 12/1972 Eby ..... 362/398
(Continued)

FOREIGN PATENT DOCUMENTS

CN 101 702 421 A 5/2010
WO WO 2009/121539 A1 10/2009
WO WO 2012/158665 11/2012

OTHER PUBLICATIONS

U.S. Appl. No. 13/739,893, filed Jan. 2013, Holland et al.
(Continued)

*Primary Examiner* — Robert May
*Assistant Examiner* — Bryon T Gyllstrom
(74) *Attorney, Agent, or Firm* — Mark Malek; Daniel Pierron; Widerman Malek, PL

(57) ABSTRACT

A luminaire carried by a lighting fixture, having a generally concave-shaped housing defining an optical chamber and an aperture, and a plurality of lighting devices each having a heat sink, a light source, and a magnetic attachment member. Each lighting device may be positioned about the inner surface of the housing. The magnetic attachment member may magnetically bind a lighting device to pads proximate to ferromagnetic material in the housing. Light emitted by the light source may enter the optical chamber and pass through the aperture in a generally orthogonal direction in relation to the orientation of the device. Electrical power may be delivered by one or more power supply units of either an external or an on-board type, and by using either inductive or conductive coupling. Network interfaces may enable communication of control instructions among a multiple controllers located either within a single luminaire or distributed among multiple luminaires.

21 Claims, 9 Drawing Sheets

(51) Int. Cl.

| | |
|---|---|
| ***F21V 21/096*** | (2006.01) |
| ***F21V 23/02*** | (2006.01) |
| ***F21V 7/00*** | (2006.01) |
| ***H05B 33/08*** | (2006.01) |
| *F21Y 101/02* | (2006.01) |
| *F21Y 111/00* | (2006.01) |
| *F21Y 113/00* | (2006.01) |
| *F21V 29/77* | (2015.01) |

(52) U.S. Cl.
CPC ..... *F21Y 2101/02* (2013.01); *F21Y 2111/002* (2013.01); *F21Y 2113/005* (2013.01)

(56) References Cited

U.S. PATENT DOCUMENTS

| | | | | |
|---|---|---|---|---|
| 5,221,877 | A | 6/1993 | Falk | |
| 5,523,878 | A | 6/1996 | Wallace et al. | |
| 5,680,230 | A | 10/1997 | Kaburagi et al. | |
| 5,704,701 | A | 1/1998 | Kavanagh et al. | |
| 5,997,150 | A | 12/1999 | Anderson | |
| 6,027,225 | A | 2/2000 | Martin et al. | |
| 6,140,646 | A | 10/2000 | Busta et al. | |
| 6,341,876 | B1 | 1/2002 | Moss et al. | |
| 6,356,700 | B1 | 3/2002 | Strobl | |
| 6,369,517 | B2 | 4/2002 | Song et al. | |
| 6,594,090 | B2 | 7/2003 | Kruschwitz et al. | |
| 6,641,283 | B1 | 11/2003 | Bohler | |
| 6,767,111 | B1 | 7/2004 | Lai | |
| 6,817,735 | B2 | 11/2004 | Shimizu et al. | |
| 6,870,523 | B1 | 3/2005 | Ben-David et al. | |
| 6,871,982 | B2 | 3/2005 | Holman et al. | |
| 6,974,713 | B2 | 12/2005 | Patel et al. | |
| 7,072,096 | B2 | 7/2006 | Holman et al. | |
| 7,075,707 | B1 | 7/2006 | Rapaport et al. | |
| 7,083,304 | B2 | 8/2006 | Rhoads | |
| 7,178,941 | B2 | 2/2007 | Roberge et al. | |
| 7,246,923 | B2 | 7/2007 | Conner | |
| 7,255,469 | B2 | 8/2007 | Wheatley et al. | |
| 7,261,453 | B2 | 8/2007 | Morejon et al. | |
| 7,289,090 | B2 | 10/2007 | Morgan | |
| 7,300,177 | B2 | 11/2007 | Conner | |
| 7,303,291 | B2 | 12/2007 | Ikeda et al. | |
| 7,325,956 | B2 | 2/2008 | Morejon et al. | |
| 7,342,658 | B2 | 3/2008 | Kowarz et al. | |
| 7,349,095 | B2 | 3/2008 | Kurosaki | |
| 7,400,439 | B2 | 7/2008 | Holman | |
| 7,429,983 | B2 | 9/2008 | Islam | |
| 7,434,946 | B2 | 10/2008 | Huibers | |
| 7,436,996 | B2 | 10/2008 | Ben-Chorin | |
| 7,438,443 | B2 | 10/2008 | Tatsuno et al. | |
| 7,476,016 | B2 | 1/2009 | Kurihara | |
| 7,479,861 | B2 | 1/2009 | Zepke et al. | |
| 7,520,642 | B2 | 4/2009 | Holman et al. | |
| 7,530,708 | B2 | 5/2009 | Park | |
| 7,540,616 | B2 | 6/2009 | Conner | |
| 7,556,406 | B2 | 7/2009 | Petroski et al. | |
| 7,598,686 | B2 | 10/2009 | Lys et al. | |
| 7,598,961 | B2 | 10/2009 | Higgins | |
| 7,626,755 | B2 | 12/2009 | Furuya et al. | |
| 7,677,736 | B2 | 3/2010 | Kasazumi et al. | |
| 7,684,007 | B2 | 3/2010 | Hull et al. | |
| 7,703,943 | B2 | 4/2010 | Li et al. | |
| 7,705,810 | B2 | 4/2010 | Choi et al. | |
| 7,709,811 | B2 | 5/2010 | Conner | |
| 7,719,766 | B2 | 5/2010 | Grasser et al. | |
| 7,728,846 | B2 | 6/2010 | Higgins et al. | |
| 7,766,490 | B2 | 8/2010 | Harbers et al. | |
| 7,806,575 | B2 | 10/2010 | Willwohl et al. | |
| 7,824,075 | B2 | 11/2010 | Maxik et al. | |
| 7,828,453 | B2 | 11/2010 | Tran et al. | |
| 7,828,465 | B2 | 11/2010 | Roberge et al. | |
| 7,832,878 | B2 | 11/2010 | Brukilacchio et al. | |
| 7,834,867 | B2 | 11/2010 | Sprague et al. | |
| 7,845,823 | B2 | 12/2010 | Mueller et al. | |
| 7,905,637 | B2 | 3/2011 | Caluori et al. | |
| 7,922,356 | B2 | 4/2011 | Maxik et al. | |
| 8,016,443 | B2 | 9/2011 | Falicoff et al. | |
| 8,047,660 | B2 | 11/2011 | Penn et al. | |
| 8,049,763 | B2 | 11/2011 | Kwak et al. | |
| 8,083,364 | B2 | 12/2011 | Allen | |
| 8,096,668 | B2 | 1/2012 | Abu-Ageel | |
| 8,172,436 | B2 | 5/2012 | Coleman et al. | |
| 8,212,836 | B2 | 7/2012 | Matsumoto et al. | |
| 8,227,813 | B2 | 7/2012 | Ward | |
| 8,297,783 | B2 | 10/2012 | Kim | |
| 8,331,099 | B2 | 12/2012 | Geissler et al. | |
| 8,337,029 | B2 | 12/2012 | Li | |
| 8,348,492 | B2 | 1/2013 | Mier-Langner et al. | |
| 8,384,984 | B2 | 2/2013 | Maxik et al. | |
| 8,454,197 | B2 | 6/2013 | Hauschulte | |
| 2004/0052076 | A1 | 3/2004 | Mueller et al. | |
| 2006/0002108 | A1 | 1/2006 | Ouderkirk et al. | |
| 2006/0002110 | A1 | 1/2006 | Dowling et al. | |
| 2006/0164005 | A1 | 7/2006 | Sun | |
| 2006/0198128 | A1* | 9/2006 | Piepgras et al. | 362/147 |
| 2006/0285193 | A1 | 12/2006 | Kimura et al. | |
| 2007/0013871 | A1 | 1/2007 | Marshall et al. | |
| 2007/0159492 | A1 | 7/2007 | Lo et al. | |
| 2007/0273299 | A1* | 11/2007 | Miskin et al. | 315/250 |
| 2008/0143973 | A1 | 6/2008 | Wu | |
| 2008/0198572 | A1 | 8/2008 | Medendorp | |
| 2008/0232084 | A1 | 9/2008 | Kon | |
| 2008/0285271 | A1* | 11/2008 | Roberge et al. | 362/235 |
| 2009/0027900 | A1 | 1/2009 | Janos et al. | |
| 2009/0036952 | A1 | 2/2009 | Kao et al. | |
| 2009/0059585 | A1 | 3/2009 | Chen et al. | |
| 2009/0128781 | A1 | 5/2009 | Li | |
| 2010/0006762 | A1 | 1/2010 | Yoshida et al. | |
| 2010/0202129 | A1 | 8/2010 | Abu-Ageel | |
| 2010/0231863 | A1 | 9/2010 | Hikmet et al. | |
| 2010/0244700 | A1 | 9/2010 | Chong et al. | |
| 2010/0315320 | A1 | 12/2010 | Yoshida | |
| 2010/0320928 | A1 | 12/2010 | Kaihotsu et al. | |
| 2010/0321641 | A1 | 12/2010 | Van Der Lubbe | |
| 2011/0310446 | A1 | 12/2011 | Komatsu | |
| 2012/0140440 | A1 | 6/2012 | Dam et al. | |
| 2012/0188769 | A1 | 7/2012 | Lau | |
| 2012/0286700 | A1 | 11/2012 | Maxik et al. | |
| 2013/0099696 | A1 | 4/2013 | Maxik et al. | |

OTHER PUBLICATIONS

U.S. Appl. No. 13/832,969, filed Mar. 2015, Holland et al.

Sengupta, Upal, "How to Implement A 5-W Wireless Power System", How2Power Today, pp. 1-8, (Jul. 2010).

* cited by examiner

CONCAVE LOW PROFILE LUMINAIRE WITH MAGNETIC LIGHTING DEVICES AND ASSOCIATED SYSTEMS AND METHODS

RELATED APPLICATIONS

This application is a continuation in part of U.S. patent application Ser. No. 13/832,969 titled Magnetically-Mountable Lighting Device and Associated Systems and Methods, filed simultaneously herewith, the entire contents of which are incorporated herein by reference. This application is also related to U.S. patent application Ser. No. 13/608,999 filed on Sep. 10, 2012 and titled System for Inductively Powering and Electrical Device and Associated Methods, the entire contents of which are incorporated herein by reference.

FIELD OF THE INVENTION

The present invention relates to low profile luminaires and, more specifically, to luminaires used to replace legacy lamps in can-type light fixtures, and associated systems and methods.

BACKGROUND OF THE INVENTION

Digital lighting technologies such as light-emitting diodes (LEDs) offer significant advantages over incandescent and fluorescent lamps. These advantages include, but are not limited to, better lighting quality, longer operating life, and lower energy consumption. Consequently, LED-based lamps are increasingly being used to replace legacy light sources in popular conventional lighting fixtures such as can-type light fixtures. However, a number of design challenges and costs are associated with replacing traditional lamps with LED illumination devices. These design challenges include thermal management, installation ease, and manufacturing cost control.

When an LED operates in a high-temperature ambient environment and/or a space-limited enclosure, the heat generated by an LED and its attending circuitry can cause overheating and premature failure of the LED. Thermal management describes a system's ability to draw heat away from an LED. Passive cooling technology, such as a heat sink thermally coupled to a digital device, may be used to transfer heat from a solid material to a fluid medium such as, for example, air. To prevent overheating of the LED, a heat sink must be designed to absorb and dissipate heat at a sufficient rate with respect to the amount of heat being generated by the LED. If the heat sink does not have the optimal amount of capacity, the heat can gradually build up behind the LED and cause damage to the components.

Retrofitting legacy lighting systems with digital lighting technology also introduces installation challenges. For example, by the very nature of their design and operation, LEDs have a directional light output. Consequently, employing LEDs to produce light distribution properties approximating or equaling the light dispersion properties of traditional lamps may require the costly and labor-intensive replacement or reconfiguration of the host light fixture, and/or the expensive and complexity-introducing design of LED-based solutions that minimize the installation impact to the host light fixture. Often material and manufacturing costs are lost in this trade off.

Power supply requirements of LED-based lighting systems also can complicate installation of LEDs as a retrofit to existing light fixtures. LEDs are low-voltage light sources that require constant DC voltage or current to operate optimally, and therefore must be carefully regulated. Too little current and voltage may result in little or no light. Too much current and voltage can damage the light-emitting junction of the LED. LEDs may be supplemented with individual power adapters to convert AC power to the proper DC voltage, and to regulate the current flowing through during operation to protect the LEDs from line-voltage fluctuations.

A need exists for a can-light retrofit luminaire that may be employed within the volume of space available in an existing light fixture, and that delivers improved lighting quality compared to traditional LED-based solutions. More specifically, a need exists for a can-light lighting solution that benefits from the advantages of digital lighting technology, while exhibiting better cut-off and reduced glare than legacy lamp solutions. Additionally, a need exists for a luminaire designed for ease of installation as well as for manufacturing cost reduction. The lighting industry is experiencing advancements in LED applications, some of which may be pertinent to certain aspects of replacing legacy lamps in can-light lighting fixtures.

U.S. Pat. No. 8,348,492 to Mier-Langner et al. discloses an LED-based luminaire that attaches to a track through magnetic connectors rather than mechanical attachment mechanisms. Multiple puck-shaped luminaires may be mechanically coupled to a non-energized support bar portion of the track, and may be electrically coupled to an electrical conductor portion of the track. However, positioning of the luminaire pucks for lighting effect is limited by the fixed, longitudinal configuration of the track, as well as by reliance on a remote power supply to provide power to each of the luminaires.

U.S. Pat. No. 8,227,813 to Ward discloses an LED-based lighting device for replacing legacy light sources in an existing light fixture having an enclosure that includes a ferromagnetic material. The LEDs are bonded to a heat-conducting substrate that includes a ferromagnetic material that magnetically bonds to the existing light fixture enclosure with sufficient force to carry the light module. However, like the Mier-Langner solution, the Ward design limits positioning of the light sources to the configuration of the substrate, and tethers the light sources to electrical conductors connected to a remote power supply.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the foregoing in mind, embodiments of the present invention are related to a luminaire adapted to be carried by a lighting fixture. The luminaire may include a plurality of lighting devices and a housing. The housing of the luminaire may be configured to be employed advantageously within the volume of space available in standard can-light lighting fixture. The lighting devices may advantageously deliver improved lighting quality compared to legacy lamps. Additionally, the luminaire may advantageously reduce the cost to manufacture and install a legacy lamp retrofit while maintaining flexibility to reconfigure the luminaire in the field.

Each of the plurality of lighting devices may comprise a heat sink and a light source. The lighting devices may comprise a first set of light sources that may emit light having a first color, and a second set of light sources that may emit light having a second color. Each light source may be in thermal communication with the thermally conductive heat sink. The housing may comprise a thermally conductive material such that the combined surface area of the respective heat sink of each of the lighting devices and of the housing may be proportional to a thermal output of the lighting devices.

The generally concave-shaped housing may have an outer surface and an inner surface. The inner surface may define an optical chamber and a substantially circular aperture. Each of the plurality of lighting devices may be positioned adjacent to and spaced apart about the inner surface of the housing such that light emitted by the light source of each of the lighting devices may enter the optical chamber and pass through the aperture. The luminaire may further comprise a reflective primary optic positioned within the inner surface of the housing such that the light emitted by each light source may be reflected by the optic through the aperture.

Each of the plurality of lighting devices also may comprise a magnetic attachment member to which its heat sink and the light source may be coupled. The magnetic attachment member may be configured to magnetically bind to a ferromagnetic material. A magnetic bond between the magnetic attachment member of each lighting device and a ferromagnetic material positioned along the inner surface of the housing may be of sufficient force to carry each of the lighting devices during normal operation.

The housing may include pads molded into the inner surface such that each pad is configured to receive a respective lighting device. The pads may be disposed in a geometric pattern about the inner surface of the housing. Each of the lighting devices may be oriented substantially tangential to a point at which the device contacts the inner surface of the housing. The light emitted by the light source of each lighting device may pass through the aperture in a generally orthogonal direction in relation to the orientation of the device. The luminaire may comprise one or more power supply units. Each power supply unit may be of an external type or an on-board type.

An on-board power supply unit may be operatively coupled to the light source and coupled to the magnetic attachment member. The on-board power supply unit may comprise at least one of a converter configured to convert an AC input voltage to a DC output voltage, and a regulator configured to sustain a DC output voltage within a target DC bias range. An external power supply unit may be carried by the housing adjacent the outer surface. Each external power supply unit may be electrically connected to one or more of the pads using either inductive coupling or conductive coupling.

In an inductive coupling electrical connection, each of the pads may comprise a transmitter coil configured to transmit a desired voltage to a receiver coil on each of the plurality of lighting devices. The voltage may be either AC or DC. In a conductive coupling electrical connection, each of the pads may comprise a plurality of electrical contacts made of an electrically conductive material. A positive contact and a negative contact may be configured to transmit a DC voltage to a lighting device. A neutral contact and a live contact may be configured to transmit an AC voltage to a lighting device.

The luminaire may have a controller operably coupled to the plurality of lighting devices and configured to selectively operate each light source of the lighting devices. The luminaire may have an occupancy sensor configured to determine whether an object is within the field of view of the occupancy sensor. The occupancy sensor is configured to transmit a positive indication when an object is determined to be within the field of view. The controller may selectively operate light sources to illuminate the field of view upon receiving the positive indication.

The luminaire may comprise a network interface, and may be included in a lighting system having at least one network. The network interface may receive communications across the network and may provide instruction to the controller. The controller may selectively operate light sources responsive to the instruction received from the network interface.

A network may be a local network configured to enable data communication among a plurality of controllers within a given luminaire. Alternatively, or in addition, a network may be a wide network configured to enable data communication among the controllers of a plurality of luminaires.

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention. Like numbers refer to like elements throughout.

Referring now to FIGS. 1-5, a concave low profile luminaire with magnetic lighting devices 100 according to an embodiment of the present invention is now described in detail. Throughout this disclosure, the present invention may be referred to as a luminaire 100, a lighting system, an LED lighting system, a lamp system, a lamp, a system, a product, and a method. Those skilled in the art will appreciate that this terminology is only illustrative and does not affect the scope of the invention. For instance, the present invention may just as easily relate to lasers or other digital lighting technologies.

Example systems and methods for a concave low profile luminaire are described herein below. In the following description, for purposes of explanation, numerous specific details are set forth to provide a thorough understanding of example embodiments. It will be evident, however, to one of ordinary skill in the art that the present invention may be practiced without these specific details and/or with different combinations of the details than are given here. Thus, specific embodiments are given for the purpose of simplified explanation and not limitation.

Figure 1A:
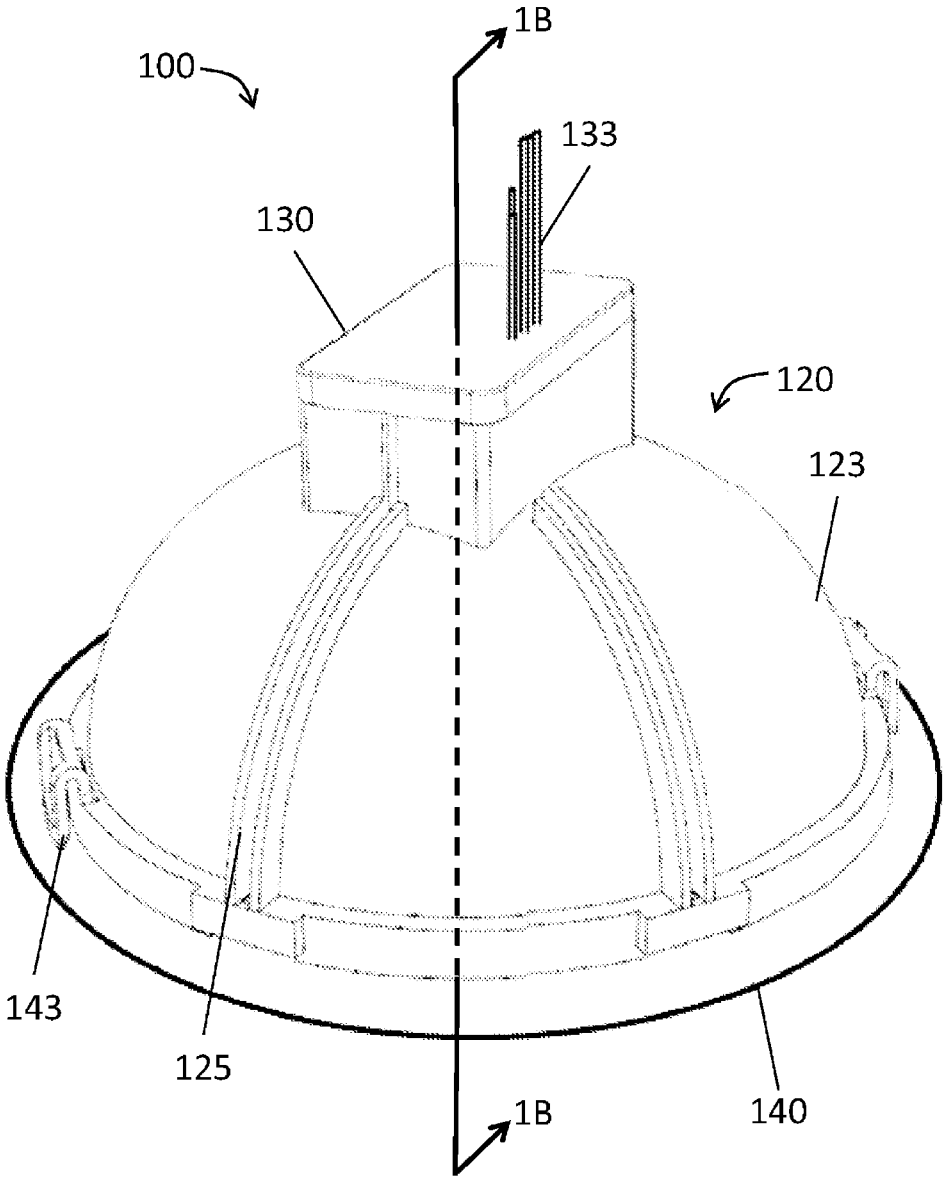
FIG. 1A is an assembled, perspective view of a luminaire according to an embodiment of the present invention.
Figure 1B:
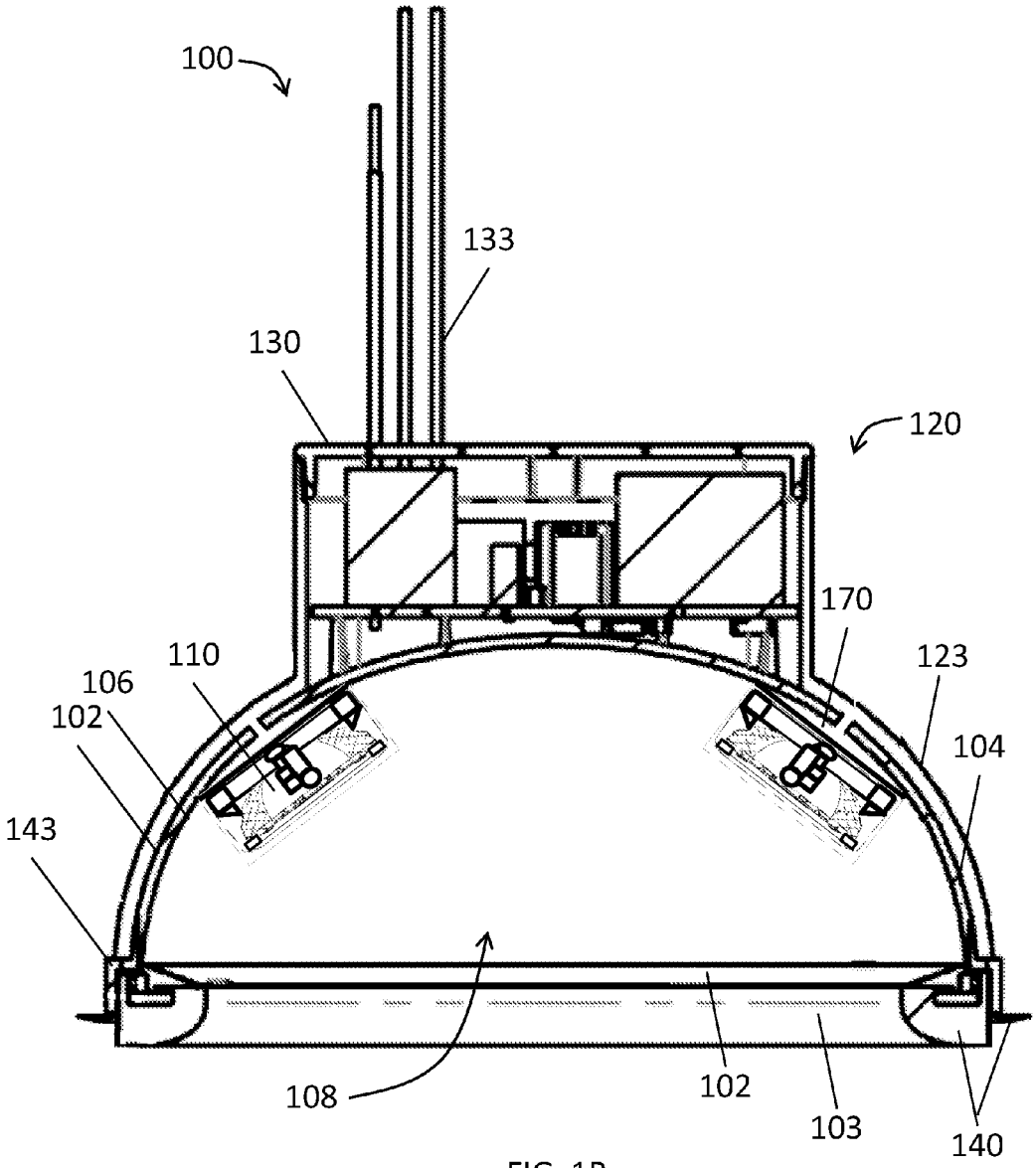
FIG. 1B is an assembled, cross-sectional view of the luminaire illustrated in FIG. 1A and taken through line 1B-1B of FIG. 1A.

Referring now, more specifically, to FIGS. 1A and 1B, a luminaire 100 according to an embodiment of the present invention will now be discussed. For purposes of definition, the term magnetically-mountable refers to adaptation to be carried through magnetic binding to a ferromagnetic material. Referring more specifically to FIGS. 1A and 1B, and additionally to FIG. 2A, the luminaire 100, according to an embodiment of the present invention, may include a plurality of lighting devices 110 and a housing 120.

The luminaire 100 and its constituent components may be configured to permit the luminaire 100 to be positioned at least partially within and attached to a light fixture such that the luminaire 100 may be carried by the light fixture. In the present embodiment, the luminaire 100 may be configured to be positioned partially within and attached to a can-light lighting fixture. The components comprising the luminaire 100 may be connected by any means known in the art, including, not by limitation, use of adhesives or glues, welding, interference fit, and fasteners. Alternatively, one or more components of the luminaire 100 may be molded during manufacturing as an integral part of the luminaire 100. An embodiment of the invention, as shown and described by the various figures and accompanying text, provides a luminaire configured to be carried by a light fixture.

Referring now to FIGS. 2A, 2B, 2C, and 2D, a magnetically-mountable lighting device 110 will now be discussed. Additional information directed to the components of the magnetically-mountable lighting device 110, and associated systems and methods, is found in U.S. patent application Ser. No. 13/832,969 titled Magnetically-Mountable Lighting Device and Associated Systems and Methods, filed simultaneously herewith, the entire contents of which are incorporated herein by reference.

Figure 2A:
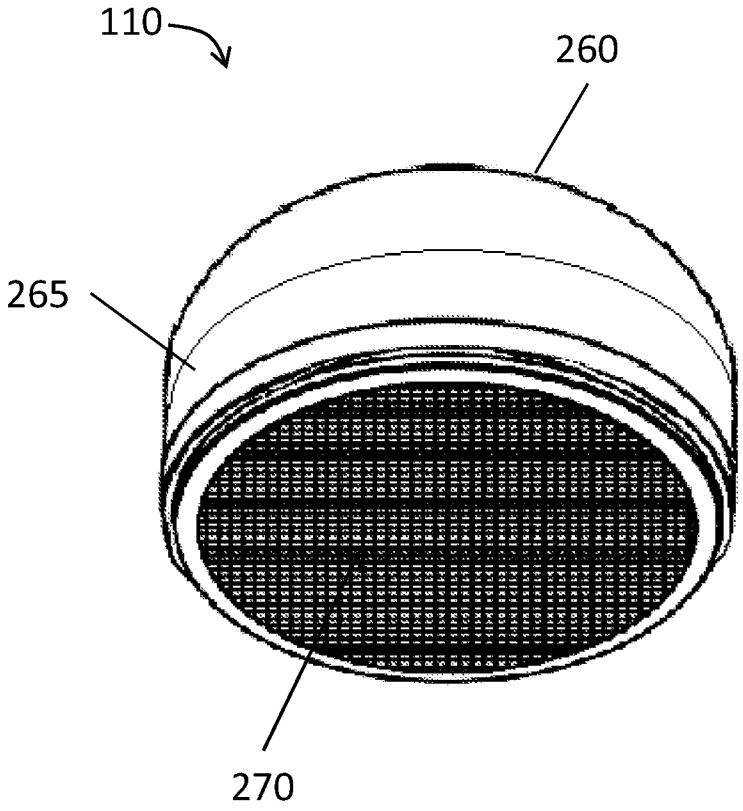
FIG. 2A is an assembled, perspective view of a magnetically-mountable lighting device of the luminaire illustrated in FIG. 1A.
Figure 2B:
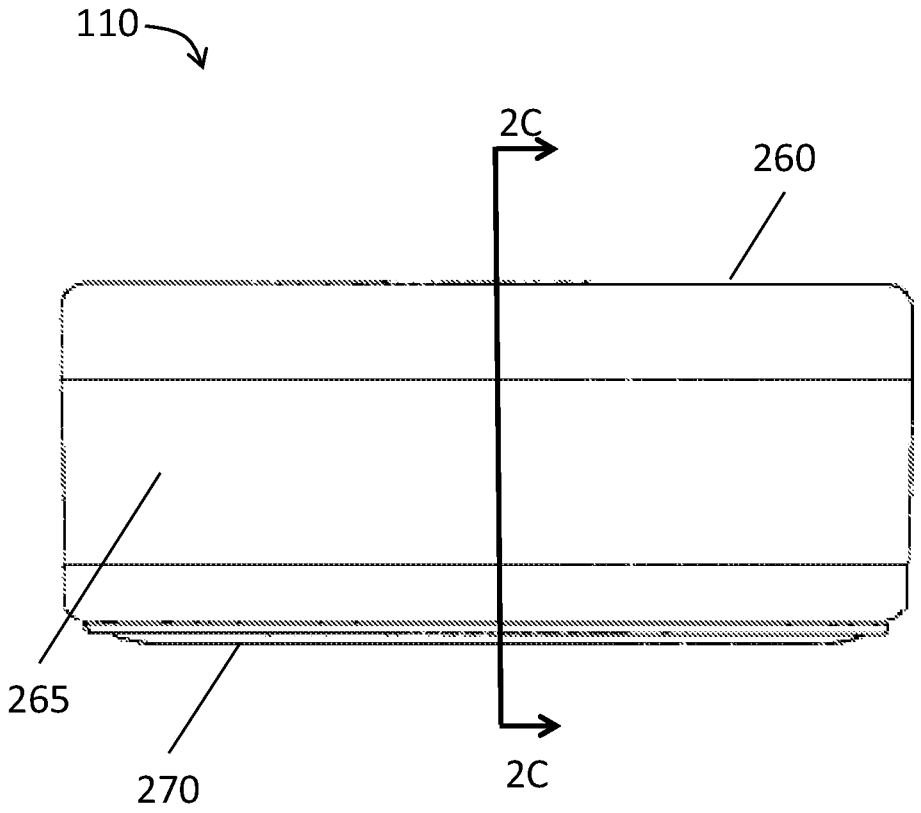
FIG. 2B is an assembled, front elevation view of the magnetically-mountable lighting device illustrated in FIG. 2A.
Figure 2C:
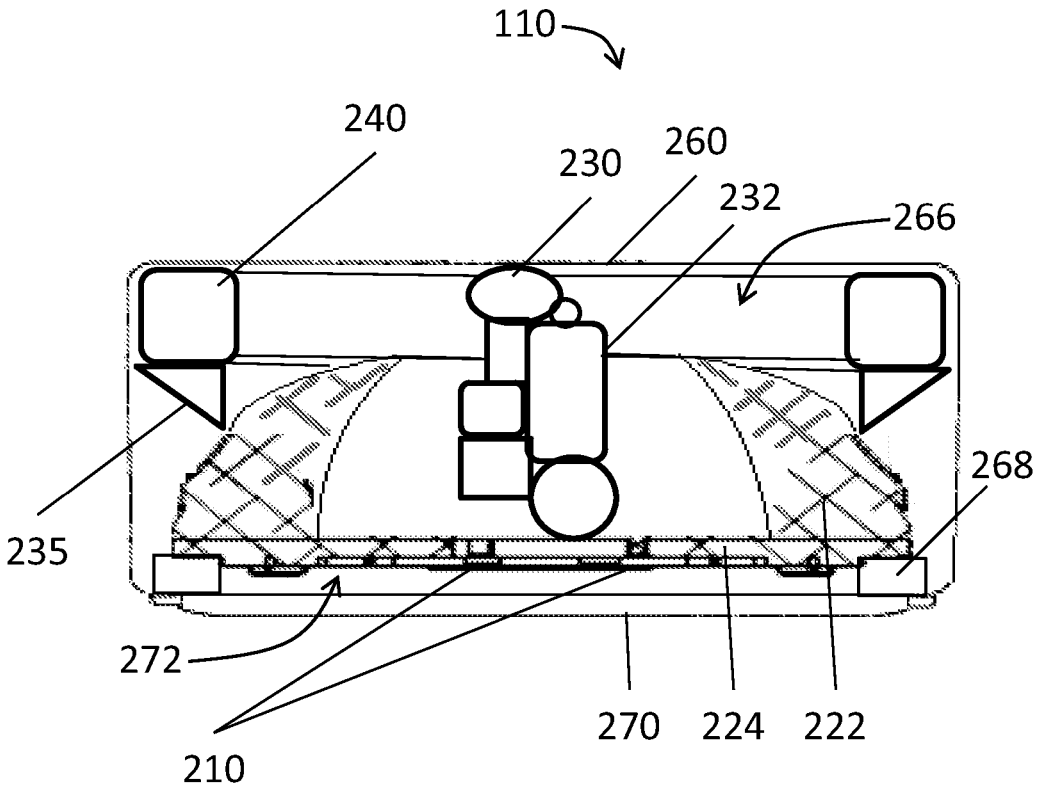
FIG. 2C is an assembled, cross-sectional view of the magnetically-mountable lighting device illustrated in FIG. 2A and taken through line 2C-2C of FIG. 2B.
Figure 2D:
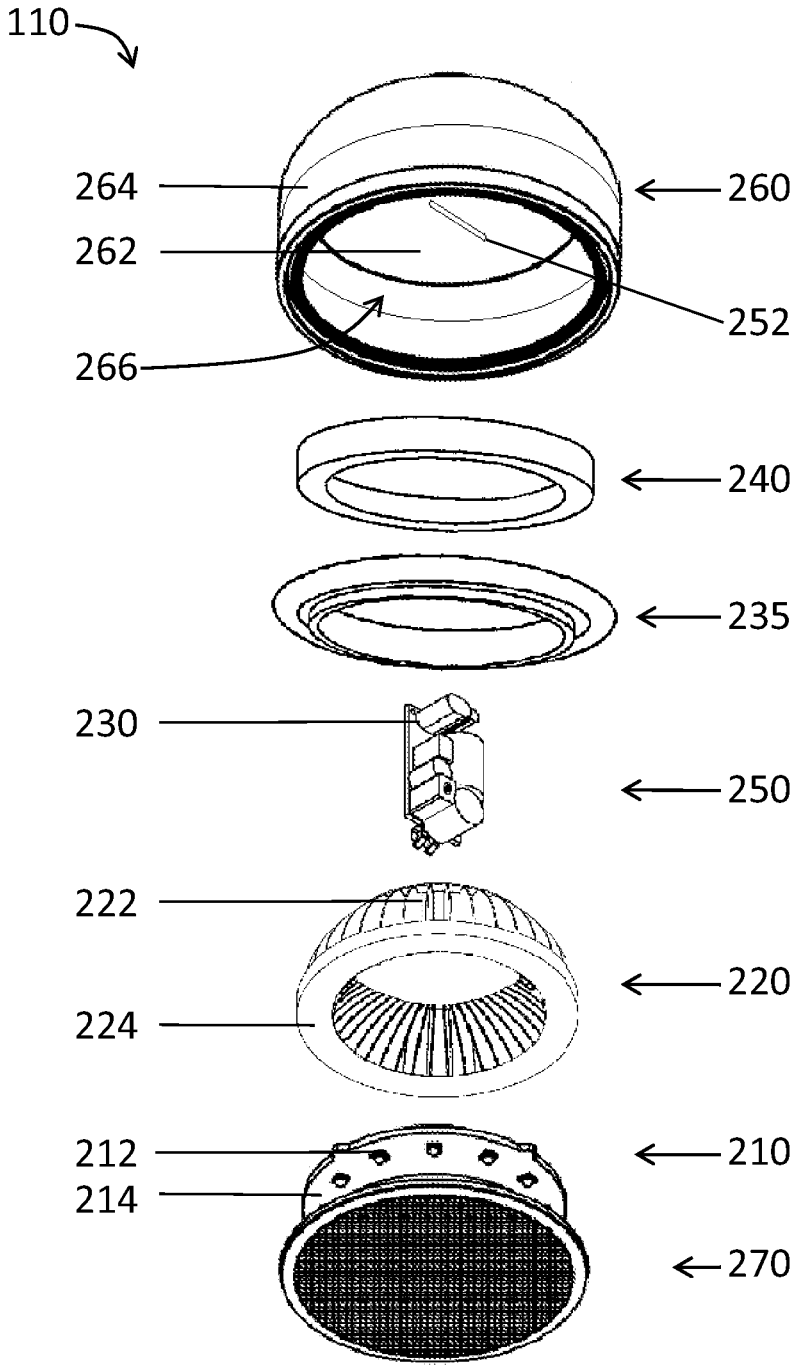
FIG. 2D is an exploded perspective view of the magnetically-mountable lighting device illustrated in FIG. 2A.

Referring more specifically to FIGS. 2C and 2D, the lighting device 110, according to an embodiment of the present invention, may include a heat generating element 210, a heat sink 220, a power source 230, a magnetic attachment member 240, an enclosure 260, and an optic 270. The heat generating element 210 may be in the form of a light source. For example, and without limitation, the assembled configuration of the lighting device 110 may present a puck-like shape, defined as generally cylindrical and having a cylinder height that is less than the cylinder width.

Referring more specifically to FIG. 2D, the heat sink 220 of the lighting device 110, according to an embodiment of the present invention, is discussed in greater detail. Thermal management capability of the lighting device 110 according to an embodiment of the present invention may be provided by one or more heat sinks 220. More specifically, the heat sink 220 may be configured to be thermally coupled to elements of the lighting device 110 so as to increase the thermal dissipation capacity of the lighting device 110. The heat sink 220 may include a number of fins 222 configured to provide a larger surface area than may otherwise be provided by the surface of the light source 210. The configuration of the fins 222 may be according to the direction of the incorporated references. For example, and without limitation, portions of a heat sink 220 may include one or more fins 222 that may be coupled with and positioned substantially perpendicular to a base portion 224.

Continuing to refer to FIGS. 2C and 2D, the light source 210 of the lighting device 110 according to an embodiment of the present invention is now discussed in greater detail. The heat sink 220 may be positioned adjacent to and in thermal communication with the light source 210. The light source 210 may comprise one or more light emitting elements 212 which may, for example and without limitation, include light-emitting semiconductors, such as light-emitting diodes (LEDs), lasers, incandescent, halogens, arc-lighting devices, fluorescents, and any other digital light-emitting device known in the art. The light source 210 may include a first and second set of light emitting elements 212 each configured to emit at wavelengths different than each other. In some embodiments of the present invention, the light source 110 may be an LED package. Additional information directed to the use of heat sinks for dissipating heat in an illumination apparatus is found in U.S. Pat. No. 7,922,356 titled Illumination Apparatus for Conducting and Dissipating Heat from a Light Source, and U.S. Pat. No. 7,824,075 titled Method and Apparatus for Cooling a Light Bulb, the entire contents of each of which are incorporated herein by reference.

Figure 3:
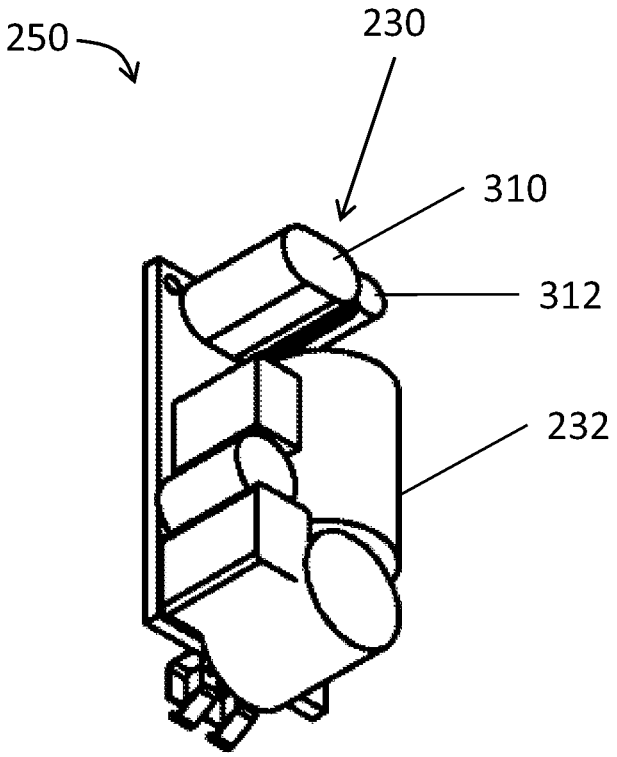
FIG. 3 is a perspective view of a component assembly of the magnetically-mountable lighting device illustrated in FIG. 2A.

Referring additionally to FIG. 3, and continuing to refer to FIGS. 2C and 2D, the power source 230 of the lighting device 110, according to an embodiment of the present invention, is discussed in greater detail. The power source 230 may be mounted on a component assembly 250 circuit board and may be operably coupled with the light source 210. For example, and without limitation, the power source 230 may be in the form of an on-board power supply unit configured to deliver electrical power to the LEDs 210. The on-board power supply unit 230 may have a converter 310 that may convert an AC input voltage to a DC output voltage. The on-board power supply unit 230 also may have a regulator 312 that may sustain a DC output voltage within a target DC bias range.

In one embodiment, the on-board power supply unit 230 may have at least one induction coil (not shown) configured to receive an AC input voltage through inductive coupling. In another embodiment, the on-board power supply unit 230 may have at least one wire connector configured to receive the AC input voltage through conductive coupling. Alternatively, the power supply unit 230 may be in the form of at least one power terminal (not shown) that receives power from a source external to the lighting device 110, and transmits that electrical power to the light source 210 and/or other electronic components comprising the component assembly 250.

The luminaire may comprise one or more power supply units. Each power supply unit may be of an external type or an on-board type. An on-board power supply unit may be operatively coupled to the light source and coupled to the magnetic attachment member. The on-board power supply unit may comprise at least one of a converter configured to convert an AC input voltage to a DC output voltage, and a regulator configured to sustain a DC output voltage within a target DC bias range.

An external power supply unit may be carried by the housing adjacent the outer surface. Each external power supply unit may be electrically connected to one or more of the pads using either inductive coupling or conductive coupling. In an inductive coupling electrical connection, each of the pads may comprise a transmitter coil configured to transmit a desired voltage to a receiver coil on each of the plurality of lighting devices. The voltage may be either AC or DC.

In a conductive coupling electrical connection, each of the pads may comprise a plurality of electrical contacts made of an electrically conductive material. A positive contact and a negative contact may be configured to transmit a DC voltage to a lighting device. A neutral contact and a live contact may be configured to transmit an AC voltage to a lighting device. Additional information directed to the use of inductive coupling is found in U.S. patent application Ser. No. 13/608,999 titled System for Inductively Powering an Electrical Device and Associated Methods, the entire contents of which are incorporated herein by reference.

Referring again to FIGS. 2A, 2B, 2C, and 2D, the enclosure 260 of the lighting device 110 according to an embodiment of the present invention will now be discussed in greater detail. The enclosure 260 may include a mounting base 262 and a sidewall 264 portion that may combine to define an interior volume known as a cavity 266. The cavity 266 may be configured to contain one or more of the light source 210, the heat sink 220, the power supply 230 and other components comprising the component assembly 250, and the magnetic attachment member 240.

Continuing to refer to FIGS. 2C and 2D, the magnetic attachment member 240 of the present embodiment will now be discussed in greater detail. The magnetic attachment member 240 may be used to fixedly or detachably mount a lighting device 110 to a ferromagnetic surface external to the lighting device 110. For example, and without limitation, the magnetic attachment member 240 may comprise a permanent magnet sized and shaped to be disposed within the cavity 266 of the enclosure 260 generally adjacent to the mounting base 262. As illustrated in FIG. 2D, for example, and without limitation, the magnetic attachment member 240 may have a generally annular shape allowing for a proximate fit to the mounting base 262. Such a configuration may position the magnetic attachment member 240 to provide mechanical support to the lighting device 110 by applying an upward force on the mounting base 262. More specifically, carrying force may be created in a direction of a ferromagnetic material external to the enclosure 260 of the lighting device 110 that may be brought into the magnetic field of the magnetic attachment member 240. The heat sink, the light source, and the power source may be mechanically coupled to the magnetic attachment member, and thereby carried by the magnetic attachment member when the lighting device is magnetically mounted to a external ferromagnetic material.

Continuing to refer to FIGS. 2A, 2B, 2C, and 2D, the optic 270 of the lighting device 110 according to an embodiment of the present invention will now be discussed in greater detail. The optic 270 may be attached to the enclosure 260 so as to define an optical chamber 272 into which light emitted by the light source 210 may enter and subsequently pass through the optic 270. The optic 270 may be configured to interact with light emitted by the light source 210 to refract incident light. Accordingly, the light source 210 may be disposed such that light emitted therefrom is incident upon the optic 270. The optic 270 may be formed in any shape to impart a desired refraction. Additionally, the optic 270 may be configured to generally diffuse light incident thereupon.

Referring again to FIGS. 1A and 1B, the housing 120 of the luminaire 100 according to an embodiment of the present invention is now discussed in greater detail.

The housing 120 may comprise an outer surface 123, an inner surface 104, and an electronics housing member 130. The electronics housing member 130 may be positioned adjacent the outer surface 123 of the housing 200 and positioned to facilitate establishment of an electrical connection between electronic components within the electronics housing member 130 and electrical devices of the luminaire 100, such as the lighting devices 110. For example, and without limitation, electrical conductor channels 125 may house electrical conductors spanning the distance from the electronic components to the respective lighting devices 110. The housing 120 may include one or more attachment sections 143. The attachment sections 143 may be configured to be at a lower end of the housing 120. For example, and without limitation, the attachment sections 143 may include optic attachment structures and/or luminaire mounting structures.

The housing 120 may be configured into a three-dimensional geometric shape so as to control the direction of light emitted from the lighting devices 110. For example, and without limitation, the housing 120 may have a generally concave-shape defining an optical chamber 108 and a substantially circular aperture 102. As shown in FIG. 1B, the housing 120 may be configured to orient lighting devices 110 positioned thereupon such that light emitted from each lighting device 110 may be directed to propagate light through the aperture 102. More specifically, each of the plurality of lighting devices 110 may be positioned adjacent to and spaced apart about the inner surface 104 of the housing such that light emitted by the light source of each of the lighting devices may enter the optical chamber 108 and pass through the aperture. The housing 120 may comprise a ferromagnetic material adjacent the inner surface 104, which may cause the magnetic attachment member 240 in the lighting devices 110 to create a carrying force necessary to magnetically attach the lighting devices to the housing 120.

While the current embodiment has specific structural features, it is contemplated and within the scope of the invention that the method of indirect lighting disclosed above may be applied to luminaires 100 having different structural features. For example, and without limitation, the use of an optical chamber, such as the optical chamber 108 of the present embodiment, may be included in the alternative form factors, as well as a color conversion layer so as to achieve desirable characteristics of light emitted by the luminaire. The positioning of the light sources 110 and the light-emitting elements 210 may take into account the direction that light emitted therefrom will propagate, as well as any other element or structure of the luminaire 100 with which it may be incident and may interact. Specifically, the light sources 110 and plurality of light-emitting elements 210 may be positioned to take into account the incidence of emitted light upon the reflective inner surface 108 and the reflection of the light therefrom. Furthermore, due to the shape of the reflective inner surface 108, the incidence of light emitted from individual light-emitting elements 210 from a certain position may result in light being reflected from the reflective inner surface 108 and propagating therefrom in a predictive direction. As described hereinabove, light reflected from the reflective inner surface 108 may propagate into the environment surrounding the luminaire 100 through the aperture 103.

Accordingly, the light-emitting elements 210 may be positioned such that light emitted from each of the plurality of light-emitting elements may propagate through the aperture 103 and into the environment surrounding the luminaire 100 in a predictive direction. For example, the light emitted from a light-emitting element may be reflected by the reflective inner surface 108 and propagate through the aperture in a direction that is generally radially opposite the radial direction of the light-emitting element 210 relative to a longitudinal axis of the luminaire 100. Additionally, where the plurality of light-emitting elements 210 are positioned in a distributed configuration, as depicted in FIG. 1B, each of the light-emitting elements 210 may be selectively operated to redirect the balance of light produced from luminaire 100.

For example, where all of the plurality of light-emitting elements 210 are operated, the light produced by the luminaire 100 may be generally equally distributed about the environment external the luminaire 100, the environment generally defined as a hemisphere beneath the aperture 103. Where only subsets or individual light-emitting elements 210 are selectively operated, the light produced by the luminaire 100 may be unevenly distributed about the environment external the luminaire 100, such as being distributed more to one side than another, or to form a staggered pattern of lighting. All distributions of light produced by the luminaire 100 into the environment surrounding the luminaire 100 are contemplated and included within the scope of the invention.

Each of the light-emitting elements 210 may emit light within a wavelength range. More specifically, each of the light-emitting elements may emit light having a wavelength range within the wavelength range from about 390 nanometers to about 750 nanometers, commonly referred to as the visible spectrum. Each of the light-emitting elements 210 may emit light having a wavelength range identical or similar to the wavelength range to another of the light-emitting elements 210, or it may emit light having a wavelength range different from another of the light-emitting elements 210.

The selection of light-emitting elements 210 included in the light source 110 may be made so as to produce a desirous combined light, as described hereinabove. Accordingly, the light source 110 may include light-emitting elements 210 that produce light having a variety of wavelengths such that the emitted light combines in the optical chamber 108 to form a combined polychromatic light. In some embodiments, the combined light may be observed by an observer in the environment external the luminaire 100 as a generally white light. Moreover, the combined light may have desirous characteristics, such as certain color temperatures and color rendering indices. The methods of forming such a combined light are discussed in the references incorporated by reference hereinabove. For example, the light source 110 may include light-emitting elements 210 that emit light that combines to produce a combined light that is generally white in color or any other color such as those represented on the 1931 CIE color space, having a color temperature within the range from about 2,000 Kelvin to about 25,000 Kelvin, and/or having a coloring rendering index within the range from about 15 to about 100. Moreover, in addition to including light-emitting elements 210 to produce a combined light having desirous characteristics, the luminaire 100 may include one or more color conversion layers configured to convert light from a first source wavelength to a second converted wavelength as described in greater detail hereinabove and hereinbelow.

Referring again to FIGS. 1A and 1B, a body member 140 may be configured to define an aperture 103. The aperture 103 may be a void formed by the body member 140 somewhere within the periphery of the body member 140. In the present embodiment, the aperture 103 may be formed approximately at the center of the body member 140. Furthermore, the aperture 103 may be configured into any geometric configuration. In the present embodiment, the aperture 103 is generally spherical. More specifically, the aperture 103 may be formed into a generally circular configuration. This embodiment is exemplary only, and the aperture 103 may be formed into any other geometric configuration, including, without limitations, ovals, semicircles, triangles, squares, and any other polygon.

The aperture 103 may be configured so as to cooperate with the aperture of the primary optic 102 to permit light that traverses through the aperture of the primary optic 102 to similarly traverse the aperture 103 and to propagate into the environment surrounding the luminaire 100.

The body member 140 may be formed into any geometric configuration. In the present embodiment, the body member 140 is formed into a generally spherical configuration. More specifically, the body member 140 may be formed into a circular configuration. Additionally, due to the positioning of the aperture 103 at the center of the body member 140 and the aperture 103 being configured as a circle, the body member 140 may be described as a ring. This embodiment is exemplary only, and the body member 140 may be formed into any other geometric configuration, including, without limitations, ovals, semicircles, triangles, squares, and any other polygon, with the aperture 103 being formed somewhere within the periphery of the geometric configuration employed. Moreover, the body member 140 and the aperture 103 may be selectively formed into identical, similar, or entirely different geometric configurations. In forming each of the body member 140 and the aperture 103, the geometric configuration of a light fixture in which the luminaire 100 may be disposed may be considered.

The body member 140 may be formed of a thermally conductive material. Forming the body member 140 of thermally conductive material may increase the thermal dissipation capacity of the heat sinks 220 of the lighting devices 110 as well as the luminaire 100 generally. Examples of thermally conductive materials include metals, metal alloys, ceramics, and thermally conductive polymers, such as CoolPoly® and Therma-Tech™. This list is not exhaustive, and all other thermally conductive materials are contemplated and within the scope of the invention.

The housing 120 may include a primary optic 102 positioned adjacent to the optical chamber 108 of the housing 120. More specifically, the primary optic 102 may be positioned so as to interface with an inner surface 104 of the housing 120. The primary optic 102 may include a reflective inner surface 106. The reflective inner surface 106 may be configured to reflect light incident thereupon. More specifically, the reflective inner surface 106 may be configured to reflect a light incident thereupon such that the reflected light has an intensity of at least 95% of the intensity of the light before being reflected.

The reflective inner surface 106 of the primary optic 102 may be configured to be reflective by any method known in the art. For example, and without limitation, the primary optic 102 may be formed of a material that is inherently reflective of light, and therefore the inner surface inherently would be reflective. As another example, the primary optic 102 may be formed of a material that may be polished to become reflective. As yet another example, the primary optic 102, or at least an inner surface of the primary optic 102, may be formed of a material that is permissive of a material being coated, attached, or otherwise disposed thereupon, the disposed material being reflective. These methods of forming the reflective inner surface 106 are exemplary only and do not serve to limit the scope of the invention. All methods known in the art of forming a reflective surface are contemplated and included within the scope of the invention.

The reflective inner surface 106 may have an efficiency associated with it. More specifically, the reflective inner surface 106 may reflect light incident thereupon at a percentage of the intensity of the incident light. For example, the reflective inner surface 106 may reflect incident light at least at about least 95% of the original intensity. The reflective inner surface 106 may be configured to reflect incident light within an intensity range from about 80% to about 99% of the original intensity.

Additionally, the reflective inner surface 106 may include a color conversion layer. The color conversion layer may be configured to receive a source light having a first wavelength, and to convert the wavelength of source light to a second wavelength, defined as a converted light. The color conversion layer may be constructed of material selected from the group consisting of phosphors, quantum dots, luminescent materials, fluorescent materials, and dyes. More details regarding the enablement and use of a color conversion layer may be found in U.S. patent application Ser. No. 13/073,805, entitled MEMS Wavelength Converting Lighting Device and Associated Methods, filed Mar. 28, 2011, as well as U.S. patent application Ser. No. 13/234,604, entitled Remote Light Wavelength Conversion Device and Associated Methods, filed Sep. 16, 2011, U.S. patent application Ser. No. 13/234,371, entitled Color Conversion Occlusion and Associated Methods, filed Sep. 16, 2011, and U.S. patent application Ser. No. 13/357,283, entitled Dual Characteristic Color Conversion Enclosure and Associated Methods, the entire contents of each of which are incorporated herein by reference.

Additionally, the reflective inner surface 106 may include two or more color conversion layers, wherein each color conversion layer is positioned upon different sections of the reflective inner surface 106. Each of the two or more color conversion layers may convert respective source lights of differing wavelengths to respective converted lights of differing wavelengths. The reflective inner surface 106 may include any number of color conversion layers in any configuration, including overlapping layers.

The primary optic 102 may be configured into any shape. As depicted in FIG. 1B, the primary optic 102 may be configured into a three-dimensional geometric shape. More specifically, the primary optic 102 may be configured into a generally curved shape. In the present embodiment, the primary optic 102 may be configured into a generally domed concave shape. Many other shapes of the primary optic 102 are contemplated and included within the scope of the invention, including, without limitation, spherical, conical, cylindrical, parabolic, pyramidal, and any other geometric configuration that may reflect light.

The primary optic 102 may at least partially define an optical chamber 108. In the present embodiment, the primary optic 102 may define an upper portion of the optical chamber 108 that is generally concave, extending upward in the direction of the housing 110. Light that traverses the optical chamber 108 and is incident upon the reflective inner surface 106 may be reflected back into the optical chamber 108 by the reflective inner surface 106. The optical chamber 108 may be configured so as to permit light that propagates through the optical chamber 108 to combine, forming a combined light. The combined light may be a polychromatic light, having multiple constituent wavelengths of light. In some embodiments, the combined light may be a white light. Additional information regarding color combination may be found in U.S. patent application Ser. No. 13/107,928, entitled High Efficacy Lighting Signal Converter and Associated Methods, filed May 15, 2011, as well as U.S. Patent Application Ser. No. 61/643,308, entitled Tunable Light System and Associated Methods, filed May 6, 2012, the entire contents of each of which are incorporated by reference herein.

The primary optic 102 may be configured to have an open end, thereby defining an aperture. The aperture may be configured to permit light traversing the optical chamber 108 to pass therethrough. Furthermore, the aperture may cooperate with additional structures of the luminaire 110 to permit the traversal of light from the optical chamber 108 to the environment.

Like the housing 120 itself, the primary optic 102 may be configured into a three-dimensional geometric shape so as to control the direction of light reflected from the reflective inner surface 106. For example, the primary optic 102 may be configured to reflect light incident thereupon such that the light is reflected to propagate through the aperture of the primary optic 102.

Continuing to refer to FIG. 1B, the housing 120 may come into thermal contact with the lighting devices 110 so as to participate in thermal management for the luminaire 110. For example, and without limitation, the housing 120 may comprise a thermally conductive material (as discussed above) such that the combined surface area of the respective heat sink 220 of each of the lighting devices 110 and of the housing 120 may be proportional to a thermal output of the lighting devices 110.

The housing 120 may include 170 pads molded into the inner surface 104 such that each pad 170 is configured to receive a respective lighting device 110. For example, and without limitation, the pads 170 may be disposed in a geometric pattern about the inner surface 104 of the housing. Each of the lighting devices 110 may be oriented substantially tangential to a point at which the device contacts the inner surface 104 of the housing 120. The light emitted by the light source 220 of each lighting device 110 may pass through the aperture 103 in a generally orthogonal direction in relation to the orientation of the device 110. This embodiment is exemplary only and all methods of removable attachment are contemplated and included within the scope of the invention.

Continuing to refer to FIG. 1A, the mounting structures 143 may be distributed in a spaced configuration about the lower housing 120 and may be configured to engage with an existing can-light fixture (not shown). In the present embodiment, the mounting structures 143 are configured as clips. This embodiment is exemplary only and all methods of removable attachment are contemplated and included within the scope of the invention.

Figure 4:
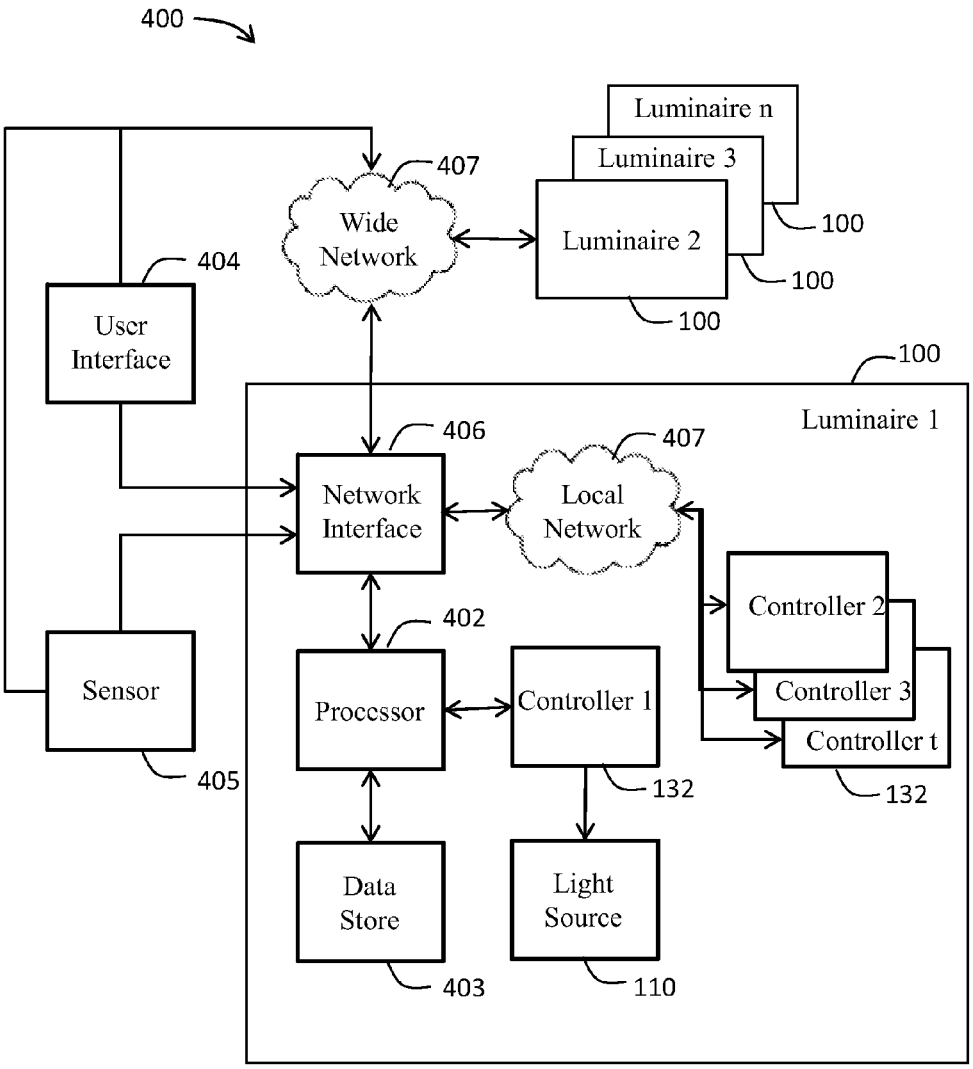
FIG. 4 is a schematic block diagram of a lighting system according to an embodiment of the present invention.

Referring now to FIG. 4, the logical components of a lighting system 400 according to one embodiment of the present invention, may comprise a one or more luminaires 100, each of which may include a controller 132 and the light source 110. The controller 132 may be designed to control the characteristics of a source light emitted by the light source 110. For example, and without limitation, the controller 132 may be configured to operate the light source 110 between operating and non-operating states, wherein the light source 110 emits light when operating, and does not emit light when not operating. The lighting device 110 also may comprise a processor 402 that may accept and execute computerized instructions, and also a data store 403 which may store data and instructions used by the processor 402. More specifically, the processor 402 may be configured to receive the input transmitted from some number of input devices 404, 405 and to direct that input to a data store 403 for storage and subsequent retrieval. For example, and without limitation, the processor 402 may be in data communication with the input device 404, 405 through a direct connection and/or through a network interface 406.

Referring additionally to FIG. 4, where the light source 110 includes a plurality of light-emitting elements 210, the controller 132 may be operably connected to the plurality of light emitting elements 210. Furthermore, the controller 132 may be operably connected to the plurality of light-emitting elements 210 so as to selectively operate each of the plurality of light-emitting elements 210. Accordingly, the controller 132 may be configured to operate the light-emitting elements 210 as described hereinabove. Moreover, the controller 132 may be configured to operate the light-emitting elements 210 so as to control the color, color temperature, and distribution of light produced by the luminaire 100 into the environment surrounding the luminaire 100 as described hereinabove.

In addition to selective operation of each of the plurality of light-emitting elements 210, the controller 132 may be configured to operate each of the plurality of light-emitting elements 210 so as to cause each light-emitting element 510 to emit light either at a full intensity or a fraction thereof. Many methods of dimming, or reducing the intensity of light emitted by a light-emitting element, are known in the art. Where the light-emitting elements 210 are LEDs, the controller 132 may use any method of dimming known in the art, including, without limitation, pulse-width modulation (PWM) and pulse-duration modulation (PDM). This list is exemplary only and all other methods of dimming a light-emitting element is contemplated and within the scope of the invention. Further disclosure regarding PWM may be found in U.S. patent application Ser. No. 13/073,805, the entire contents of which are incorporated by reference hereinabove.

The luminaire may have an occupancy sensor configured to determine whether an object is within the field of view of the occupancy sensor. The occupancy sensor is configured to transmit a positive indication when an object is determined to be within the field of view. The controller may selectively operate light sources to illuminate the field of view upon receiving the positive indication.

In some embodiments, the luminaire 100 may further include a sensor 405. The sensor 405 may be configured to affect the operation of the light source 110. For example, the sensor 405 may be in electrical communication with a controller 132 as described hereinabove. The sensor 405 may transmit a signal to the controller 132 indicating that the controller 132 should either operate the light source 110 or cease operation of the light source 110. For example, the sensor 405 may be an occupancy sensor that detects the presence of a person within a field of view of the occupancy sensor. When a person is detected, the occupancy sensor 405 may indicate to the controller 132 that the light source 110 should be operated so as to provide lighting for the detected person. Accordingly, the controller 132 may operate the light source 110 so as to provide lighting for the detected person.

Furthermore, the occupancy sensor 405 may either indicate that lighting is no longer required when a person is no longer detected, or either of the occupancy sensor or the controller 132 may indicate lighting is no longer required after a period of time transpires during which a person is not detected by the occupancy sensor. Accordingly, in either situation, the controller 132 may cease operation of the light source 110, terminating lighting of the environment surrounding the luminaire 100. The sensor 405 may be any sensor capable of detecting the presence or non-presence of a person in the environment surrounding the luminaire 100, including, without limitation, infrared sensors, motion detectors, and any other sensor of similar function known in the art. More disclosure regarding motion-sensing luminaires and occupancy sensors may be found in U.S. patent application Ser. No. 13/403,531, entitled Configurable Environmental Sensing Luminaire, System and Associated Methods, filed Feb. 23, 2012, and U.S. patent application Ser. No. 13/464,345, entitled Occupancy Sensor and Associated Methods, filed May 4, 2012, the entire contents of both of which are herein incorporated by reference.

A network may be a local network 407 configured to enable data communication among a plurality of controllers within a given luminaire. Alternatively, or in addition, a network may be a wide network 406 configured to enable data communication among the controllers of a plurality of luminaires.

Additionally, the luminaire 100 may further include a network interface 406. The network interface 406 may be configured to establish connection with a network 407 and communicate with other electronic devices similarly connected to the network 407 there across. Furthermore, the network interface 406 may be in communication with the various electronic components and devices of the luminaire 100, thereby enabling the various electronic components and devices of the luminaire 100 to communicate with other electronic devices across the network 407. For example, the network interface 406 may connect to a network of a plurality of luminaires 100 according to the present invention. Furthermore, the luminaire 100 may be configured to transmit and/or receive signals across the network 407 via the network interface 406 affecting the operation of light source 110. For example, the luminaire 100, or more specifically an electronic device of the luminaire, such as a controller 132, may be placed in communication with the network interface 406 and receive a signal across the network 407 containing an instruction to either operate or cease operation of the light source 110. The controller 132 may then operate the light source 110 responsive to the received signal. Furthermore, the controller 132 may similarly transmit a signal to other luminaires across the network 407 with a similar instruction to either operate or cease operation of the luminaires' respective light sources. More disclosure regarding networked lighting and attending luminaires may be found in U.S. patent application Ser. No. 13/463,020, entitled Wireless Pairing System and Associated Methods, filed May 3, 2012 and U.S. patent application Ser. No. 13/465,921, entitled Sustainable Outdoor Lighting System and Associated Methods, filed May 7, 2012, the entire contents of both of which are incorporated herein by reference.

Figure 5:
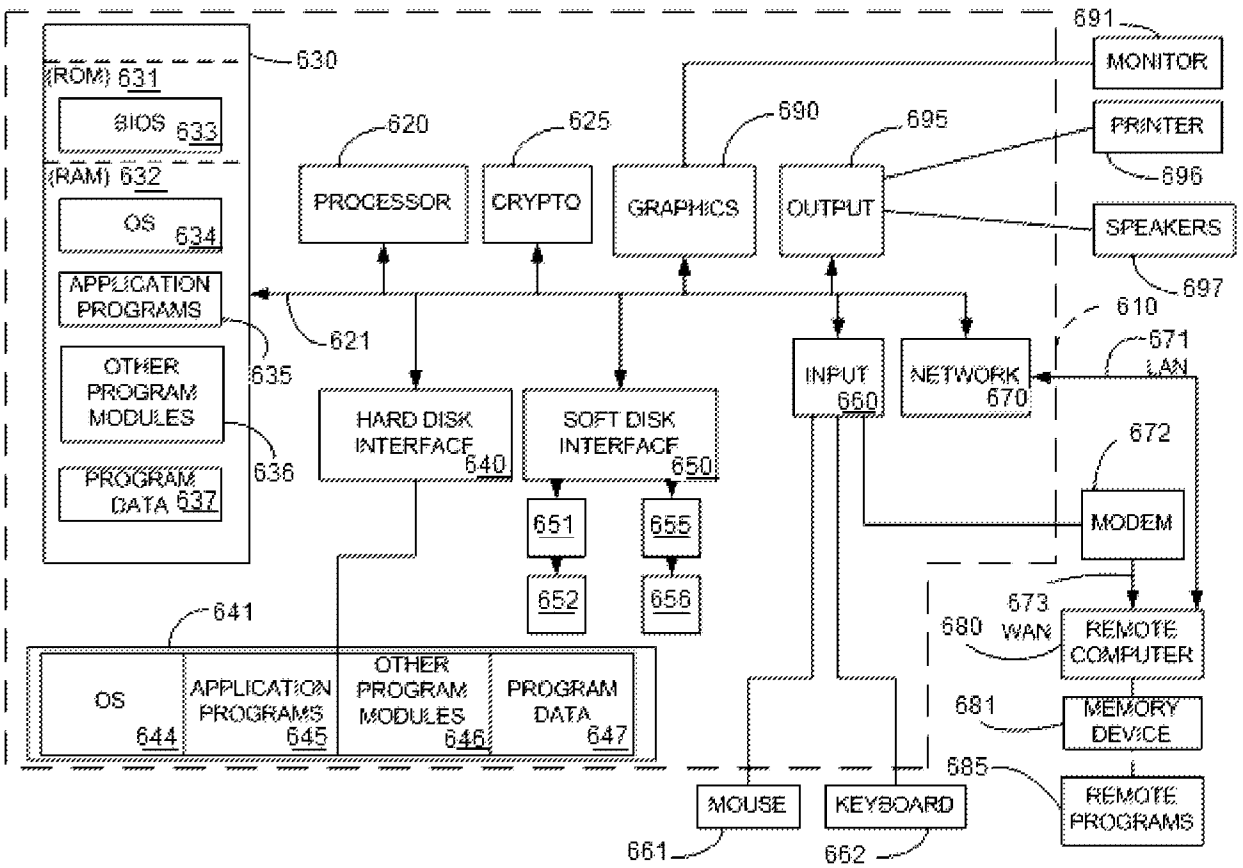
FIG. 5 is a block diagram representation of a machine in the example form of a computer system according to an embodiment of the present invention.

A skilled artisan will note that one or more of the aspects of the present invention may be performed on a computing device. The skilled artisan will also note that a computing device may be understood to be any device having a processor, memory unit, input, and output. This may include, but is not intended to be limited to, cellular phones, smart phones, tablet computers, laptop computers, desktop computers, personal digital assistants, etc. FIG. 5 illustrates a model computing device in the form of a computer 610, which is capable of performing one or more computer-implemented steps in practicing the method aspects of the present invention. Components of the computer 610 may include, but are not limited to, a processing unit 620, a system memory 630, and a system bus 621 that couples various system components including the system memory to the processing unit 620. The system bus 621 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI).

The computer 610 may also include a cryptographic unit 625. Briefly, the cryptographic unit 625 has a calculation function that may be used to verify digital signatures, calculate hashes, digitally sign hash values, and encrypt or decrypt data. The cryptographic unit 625 may also have a protected memory for storing keys and other secret data. In other embodiments, the functions of the cryptographic unit may be instantiated in software and run via the operating system.

A computer 610 typically includes a variety of computer readable media. Computer readable media can be any available media that can be accessed by a computer 610 and includes both volatile and nonvolatile media, removable and non-removable media. By way of example, and not limitation, computer readable media may include computer storage media and communication media. Computer storage media includes volatile and nonvolatile, removable and non-removable media implemented in any method or technology for storage of information such as computer readable instructions, data structures, program modules or other data. Computer storage media includes, but is not limited to, RAM, ROM, EEPROM, FLASH memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by a computer 610. Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, radio frequency, infrared and other wireless media. Combinations of any of the above should also be included within the scope of computer readable media.

The system memory 630 includes computer storage media in the form of volatile and/or nonvolatile memory such as read only memory (ROM) 631 and random access memory (RAM) 632. A basic input/output system 633 (BIOS), containing the basic routines that help to transfer information between elements within computer 610, such as during start-up, is typically stored in ROM 631. RAM 632 typically contains data and/or program modules that are immediately accessible to and/or presently being operated on by processing unit 620. By way of example, and not limitation, FIG. 5 illustrates an operating system (OS) 634, application programs 635, other program modules 636, and program data 637.

The computer 610 may also include other removable/non-removable, volatile/nonvolatile computer storage media. By way of example only, FIG. 5 illustrates a hard disk drive 641 that reads from or writes to non-removable, nonvolatile magnetic media, a magnetic disk drive 651 that reads from or writes to a removable, nonvolatile magnetic disk 652, and an optical disk drive 655 that reads from or writes to a removable, nonvolatile optical disk 656 such as a CD ROM or other optical media. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like. The hard disk drive 641 is typically connected to the system bus 621 through a non-removable memory interface such as interface 640, and magnetic disk drive 651 and optical disk drive 655 are typically connected to the system bus 621 by a removable memory interface, such as interface 650.

The drives, and their associated computer storage media discussed above and illustrated in FIG. 5, provide storage of computer readable instructions, data structures, program modules and other data for the computer 610. In FIG. 5, for example, hard disk drive 641 is illustrated as storing an OS 644, application programs 645, other program modules 646, and program data 647. Note that these components can either be the same as or different from OS 633, application programs 633, other program modules 636, and program data 637. The OS 644, application programs 645, other program modules 646, and program data 647 are given different numbers here to illustrate that, at a minimum, they may be different copies. A user may enter commands and information into the computer 610 through input devices such as a keyboard 662 and cursor control device 661, commonly referred to as a mouse, trackball or touch pad. Other input devices (not shown) may include a microphone, joystick, game pad, satellite dish, scanner, or the like. These and other input devices are often connected to the processing unit 620 through a user input interface 660 that is coupled to the system bus, but may be connected by other interface and bus structures, such as a parallel port, game port or a universal serial bus (USB). A monitor 691 or other type of display device is also connected to the system bus 621 via an interface, such as a graphics controller 690. In addition to the monitor, computers may also include other peripheral output devices such as speakers 697 and printer 696, which may be connected through an output peripheral interface 695.

The computer 610 may operate in a networked environment using logical connections to one or more remote computers, such as a remote computer 680. The remote computer 680 may be a personal computer, a server, a router, a network PC, a peer device or other common network node, and typically includes many or all of the elements described above relative to the computer 610, although only a memory storage device 681 has been illustrated in FIG. 5. The logical connections depicted in FIG. 5 include a local area network (LAN) 671 and a wide area network (WAN) 673, but may also include other networks 140. Such networking environments are commonplace in offices, enterprise-wide computer networks, intranets and the Internet.

When used in a LAN networking environment, the computer 610 is connected to the LAN 671 through a network interface or adapter 670. When used in a WAN networking environment, the computer 610 typically includes a modem 672 or other means for establishing communications over the WAN 673, such as the Internet. The modem 672, which may be internal or external, may be connected to the system bus 621 via the user input interface 660, or other appropriate mechanism. In a networked environment, program modules depicted relative to the computer 610, or portions thereof, may be stored in the remote memory storage device. By way of example, and not limitation, FIG. 5 illustrates remote application programs 685 as residing on memory device 681.

The communications connections 670 and 672 allow the device to communicate with other devices. The communications connections 670 and 672 are an example of communication media. The communication media typically embodies computer readable instructions, data structures, program modules or other data in a modulated data signal such as a carrier wave or other transport mechanism and includes any information delivery media. A "modulated data signal" may be a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Computer readable media may include both storage media and communication media.

Some of the illustrative aspects of the present invention may be advantageous in solving the problems herein described and other problems not discussed which are discoverable by a skilled artisan. While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus the scope of the invention should be determined by the appended claims and their legal equivalents, and not by the examples given.

What is claimed is:

1. A luminaire adapted to be carried by a light fixture comprising: a generally concave-shaped housing comprising: an outer surface, and a domed inner surface opposite the outer surface, the inner surface comprising a ferromagnetic material and defining an optical chamber and a substantially circular aperture; and a plurality of lighting devices each comprising: a heat sink, a light source in thermal communication with the heat sink; and a magnetic attachment member comprising a permanent magnet, and configured to proximately fit the inner surface; wherein the magnetic attachment member is positionable adjacent the inner surface and is configured to magnetically bind to the ferromagnetic material of the housing; wherein the magnetic attachment member, the heat sink, and the light source are carried by the housing; wherein each of the plurality of lighting devices is positionable adjacent to and spaced apart about the inner surface of the housing; and wherein light emitted by the light source of each of the plurality of lighting devices enters the optical chamber and passes through the substantially circular aperture.

2. The luminaire according to claim 1 wherein an orientation of each of the plurality of lighting devices is substantially tangential to a respective point at which the each of the plurality of lighting devices contacts the inner surface of the housing; and wherein the light emitted by the light source of the each of the plurality of lighting devices passes through the substantially circular aperture in a generally orthogonal direction in relation to the orientation of the each of the plurality of lighting devices.

3. The luminaire according to claim 1 wherein the housing comprises a ferromagnetic material positioned along at least the inner surface thereof; and wherein a magnetic bond between the each magnetic attachment member and the housing is of sufficient force to carry the respective each of the plurality of lighting devices during normal operation.

4. The luminaire according to claim 1 wherein the heat sink comprises at least one thermally conductive material selected from the group consisting of thermoplastic, ceramic, porcelain, aluminum, and aluminum alloys.

5. The luminaire according to claim 4 wherein the housing comprises at least one thermally conductive material selected from the group consisting of thermoplastic, ceramic, porcelain, aluminum, and aluminum alloys; and wherein a combined surface area of the respective heat sink of each of the plurality of lighting devices and of the housing is proportional to a thermal output of the plurality of lighting devices.

6. The luminaire according to claim 1 wherein the housing comprises a plurality of pads each molded into the inner surface and configured to receive each of the respective plurality of lighting devices.

7. The luminaire according to claim 6 wherein the plurality of pads are disposed in a geometric pattern about the inner surface of the housing.

8. The luminaire according to claim 6 further comprising one or more external power supply units carried by the housing adjacent the outer surface, wherein each of the one or more external power supply units is electrically connected to one or more of the plurality of pads; wherein each of the plurality of pads comprises a transmitter coil configured to transmit a DC voltage to a receiver coil on a respective each of the plurality of lighting devices through inductive coupling.

9. The luminaire according to claim 6 wherein each of the plurality of lighting devices further comprises an on-board power supply unit operatively coupled to the light source and coupled to the magnetic attachment member; wherein the on-board power supply unit comprises at least one of a converter and a regulator; wherein the converter is configured to convert an AC input voltage to a DC output voltage; wherein the regulator is configured to sustain a DC output voltage within a target DC bias range; wherein each of the plurality of pads comprises a transmitter coil configured to transmit an AC voltage to a receiver coil on a respective each of the plurality of lighting devices through inductive coupling.

10. The luminaire according to claim 6 wherein each of the plurality of pads comprises a plurality of electrical contacts.

11. The luminaire according to claim 10 further comprising one or more external power supply units carried by the housing adjacent the outer surface and each of the one or more external power supply units electrically connected to one or more of the plurality of pads; wherein each of the plurality of pads comprises an electrically conductive material and includes a positive contact and a negative contact configured to transmit a DC voltage to a respective each of the plurality of lighting devices through conductive coupling.

12. The luminaire according to claim 10 wherein each of the plurality of lighting devices further comprises an on-board power supply unit operatively coupled to the light source and coupled to the magnetic attachment member; wherein the on-board power supply unit comprises at least one of a converter and a regulator; wherein the converter is configured to convert an AC input voltage to a DC output voltage; wherein the regulator is configured to sustain a DC output voltage within a target DC bias range; wherein each of the plurality of pads comprises an electrically conductive material and includes a neutral contact and a live contact configured to transmit an AC voltage to a respective each of the plurality of lighting devices through conductive coupling.

13. The luminaire according to claim 1 further comprising a controller operably coupled to the plurality of lighting devices; wherein the controller is configured to selectively operate each light source of the plurality of lighting devices.

14. The luminaire according to claim 13 wherein each of the plurality of lighting devices further comprises a first light source operable to emit light within a first wavelength range corresponding to a first color, and a second light source operable to emit light within a second wavelength range corresponding to a second color.

15. The luminaire according to claim 13 further comprising a reflective primary optic disposed within the inner surface of the housing and positioned such that the light emitted by the light source of the each of the plurality of lighting devices is incident upon the reflective primary optic and is reflected by the reflective primary optic through the substantially circular aperture.

16. The luminaire according to claim 13 further comprising an occupancy sensor having a field of view;

wherein the controller is in communication with the occupancy sensor;

wherein the occupancy sensor is configured to determine whether an object is within the field of view of the occupancy sensor;

wherein the occupancy sensor is configured to transmit a positive indication when an object is determined to be within the field of view; and wherein the controller is configured to operate the light source of each of the plurality of lighting devices to illuminate the field of view of the occupancy sensor upon receiving the positive indication.

17. The luminaire according to claim 13 further comprising a network interface configured to enable communication with a network;

wherein the controller is in communication with the network interface;

wherein the network interface is operable to receive communications across the network and provide an instruction to the controller; and wherein the controller operates at least one light source of the plurality of lighting devices responsive to the instruction received from the network interface.

18. A lighting system comprising: at least one network; at least one luminaire comprising: a generally concave-shaped housing comprising an outer surface, and an inner surface opposite the outer surface, the inner surface comprising a ferromagnetic material and defining an optical chamber and a substantially circular aperture, a plurality of lighting devices each comprising: a heat sink, a light source in thermal communication with the heat sink, and a magnetic attachment member comprising a permanent magnet, and configured to proximately fit the inner surface, wherein the magnetic attachment member is positionable adjacent the inner surface and is configured to magnetically bind to a the ferromagnetic material of the housing, and wherein the magnetic attachment member, the heat sink and the light source are carried by the housing; at least one network interface configured to transmit and receive control instruction data through the at least one network; at least one controller operably coupled to a respective at least one of the lighting devices and configured to selectively operate at least one of the lighting devices responsive to the control instruction data received from the at least one network interface; wherein each of the plurality of lighting devices is positionable adjacent to and spaced apart about the inner surface of the housing; and wherein light emitted by the light source enters the optical chamber and passes through the substantially circular aperture.

19. The lighting system according to claim 18 wherein the at least one controller comprises a plurality of controllers; and wherein the at least one network further comprises a local network configured to enable data communication among more than one of the plurality of controllers.

20. The lighting system according to claim 18 wherein the at least one luminaire comprises a plurality of luminaires; and wherein the at least one network further comprises a wide network configured to enable data communication among the at least one controller of more than one of the plurality of luminaires.

21. The lighting system according to claim 18 further comprising a sensor configured to determine whether an object is within a field of view of the sensor and to transmit as the control instruction data a positive indication when an object is determined to be within the field of view; and wherein the at least one controller is configured to selectively operate at least one of the plurality of lighting devices to illuminate the field of view responsive to the positive indication.

* * * * *